US005831194A

United States Patent [19]

Kaneko et al.

[11] Patent Number: 5,831,194

[45] Date of Patent: Nov. 3, 1998

[54] ELECTRONIC KEYBOARD MUSICAL INSTRUMENT CAPABLE OF IMPARTING EFFECT SIMILAR TO THAT OF SOFT PEDAL

[75] Inventors: Yasutoshi Kaneko; Kiyoshi Kawamura; Rei Furukawa; Shinya Koseki, all of Hamamatsu, Japan

[73] Assignee: Yamaha Corporation, Japan

[21] Appl. No.: 837,902

[22] Filed: Apr. 22, 1997

[30] Foreign Application Priority Data

Apr. 26, 1996 [JP] Japan ..... 8-107756

[51] Int. Cl.[6] ..... G10H 1/057; G10H 7/04

[52] U.S. Cl. ..... 84/605; 84/627; 84/663; 84/DIG. 9

[58] Field of Search ..... 84/604–607, 626–633, 84/662–665, 701–711, 737–741, DIG. 9, 644, 670, 721, 746

[56] References Cited

U.S. PATENT DOCUMENTS 4,909,121 3/1990 Vsa et al. ..... 84/627 X
5,136,916 8/1992 Shibukawa ..... 84/627
5,241,130 8/1993 Shibukawa ..... 84/662 X
5,498,834 3/1996 Inagaki et al. ..... 84/737 X
5,641,929 6/1997 Okamoto et al. ..... 84/633 X

*Primary Examiner*—Stanley J. Witkowski
*Attorney, Agent, or Firm*—Graham & James LLP

[57] ABSTRACT

An electronic keyboard musical instrument is responsive to a step-on of a soft pedal so as to impart effects similar to those of a soft pedal of an acoustic piano to an electronic sound; a tone generator incorporated in the electronic keyboard musical instrument causes a series of waveform data codes to be read out at a higher speed so as to slightly increase the pitch of an electronic sound, an envelop generator to give a gentle envelop with a small attack and a long sustain to the electronic sound and a filter circuit to emphasize a certain high frequency component, thereby making the electronic sound to be quite close to the piano sound produced under the step-on of the soft pedal.

4 Claims, 3 Drawing Sheets

ELECTRONIC KEYBOARD MUSICAL INSTRUMENT CAPABLE OF IMPARTING EFFECT SIMILAR TO THAT OF SOFT PEDAL

FIELD OF THE INVENTION

This invention relates to an electronic keyboard musical instrument and, more particularly, to an electronic keyboard musical instrument capable of imparting an effect similar to the effect of the soft pedal of an acoustic piano.

DESCRIPTION OF THE RELATED ART

A pianist not only selectively fingers the keys on the keyboard but also steps on pedals so as to change the piano sounds. When the pianist steps on the damper pedal, the dampers are hold over the strings after release of the depressed keys, and prolong the piano sounds. The soft pedal causes the hammers to strike the strings smaller in number than those without the step-on of the soft pedal, and lessens the loudness of the piano sounds. The effects imparted by the damper pedal and the soft pedal are hereinbelow referred to as "damper effect" and "soft effect", respectively.

An electronic keyboard musical instrument is designed to allow a player to give similar effects to the electronic sounds. When a player steps on the damper pedal of the electronic keyboard musical instrument, the tone generator changes the sustain of the envelop for electronic sounds, and retards the extinguishment of the electronic sound. Thus, the damper effect is easily realized by simply prolonging the sustain of the envelop.

On the other hand, the soft effect is hardly realized by the electronic keyboard musical instrument. This is because of the fact that the soft effect of an acoustic piano is complex. As described hereinbefore, when a pianist steps on the soft pedal of an acoustic piano, the hammer strikes a smaller number of strings than usual. The vibrations of the smaller number of strings are gently decayed, and, accordingly, the piano sound is prolonged. However, the soft effect is not limited to the prolongation of the acoustic sound. The smaller number of strings slightly increase the frequency of vibrations, and, accordingly, slightly lifts the pitch of the piano sounds. Thus, the soft effect is complex, and the prior art electronic keyboard musical instrument can not presently impart the complicated soft effect to the electronic sounds.

SUMMARY OF THE INVENTION

It is therefore an important object of the present invention to provide an electronic keyboard musical instrument which allows a player to impart the complicated soft effect to electronic sounds.

To accomplish the object, the present invention proposes to sequentially read out pieces of waveform data at a certain speed higher than usual.

In accordance with the present invention, there is provided an electronic keyboard musical instrument comprising a keyboard having a plurality of keys selectively depressed by a player for specifying a note of an electronic sound, a pedal depressed by the player for imparting predetermined effects to the electronic sound and a tone generator responsive to one of the plurality of keys depressed by the player for producing the electronic sound, and the tone generator is further responsive to the aforesaid one of the plurality of keys and the pedal depressed by the player for not only slightly increasing the pitch of the electronic sound but also decreasing the loudness of the electronic sound.

BRIEF DESCRIPTION OF THE DRAWINGS

The features and advantages of the electronic keyboard musical instrument according to the present invention will be more clearly understood from the following description taken in conjunction with the accompanying drawings in which.

DESCRIPTION OF THE PREFERRED EMBODIMENTS

First Embodiment

Figure 1:
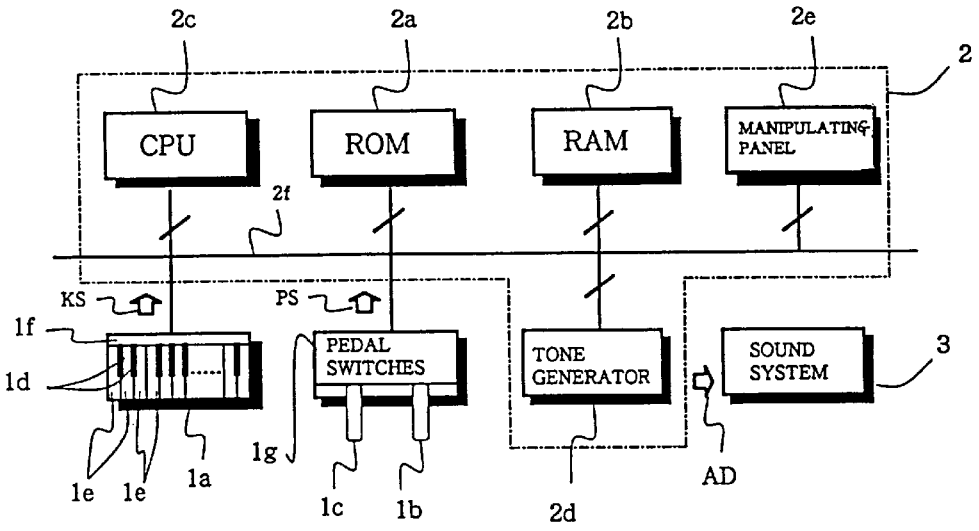
FIG. 1 is a block diagram showing an electronic keyboard musical instrument according to the present invention.

Referring first to FIG. 1 of the drawings, an electronic keyboard musical instrument embodying the present invention comprises a keyboard 1*a*, a damper pedal 1*b* and a soft pedal 1*c*. The electronic keyboard musical instrument is called an "electronic piano", and the keyboard 1*a* and the pedals 1*b*/1*c* correspond to those of an acoustic piano. The keyboard la is supported by a case (not shown), and laterally extends in front of a player sitting on a chair (not shown). The keyboard has a plurality of black and white keys 1*d*/1*e* arranged similar to the keyboard of an acoustic piano, and the plurality of black and white keys 1*d*/1*e* are respectively associated with key switches 1*f* so as to detect a change of key status. The key switches 1*f* are closed or opened by the associated keys 1*d*/1*e*, respectively, and the matrix of key switches 1*f* produces key status signals KS each representative of the current key status of the associated key 1*d*/1*e*. Notes of a scale are respectively assigned to the black and white keys 1*d*/1*e*, and the player selectively specifies the notes by depressing the keys 1*d*/1*e*. The notes respectively assigned to the keys 1*d*/1*e* are identified with key codes, respectively.

The damper pedal 1*b* and the soft pedal 1*c* project from a lower portion of the case, and the player can step on the damper pedal 1*b* and the soft pedal 1*c*. The damper pedal 1*b* and the soft pedal 1*c* are also associated with pedal switches 1*g*, and the pedal switches 1*g* monitors the damper pedal 1*b* and the soft pedal 1*c* to see whether or not the player steps on the damper pedal 1*b* or the soft pedal 1*c*. The pedal switches 1*g* produce pedal status signals PS each representative of the current pedal status of the associated one of the damper pedal 1*b* and the soft pedal 1*c*.

The electronic keyboard musical instrument further comprises a music data processing system 2 and a sound system 3. The music data processing system 2 periodically scans the keyboard 1*a* and the damper/soft pedals 1*b*/1*c* to see whether or not the player manipulates the black and white keys 1*d*/1*e* and the damper/soft pedals 1*b*/1*c*. When the player depresses and, thereafter, releases a key 1*d*/1*e*, the music data processing system 2 tailors an analog audio signal AD through a digital data processing, and supplies the analog audio signal AD to the sound system 3.

The music data processing system 2 can modify the analog audio signal AD in response to the damper pedal 1*b*.

However, the signal processing for the damper pedal 1*b* is similar to that of the prior art, and description is focused on a signal processing for the soft pedal 1*c*.

The sound system 3 includes an amplifier and speakers. The amplifier increases the amplitude of the analog audio signal AD to a range specified by the player, and the speakers produce an electronic sound with the note assigned the depressed/released key 1*d*/1*e* from the analog audio signal AD.

The music data processing system 2 includes a read only memory 2*a*, a random access memory 2*b*, a central processing unit 2*c*, a tone generator 2*d* and a manipulating panel 2*e*, and these component units 2*a* to 2*e* are connected through a shared bus 2*f*.

Though not shown in FIG. 1, a suitable signal interface is connected between the shared bus 2*f* and the matrix of key switches 1*g*/pedal switches 1*g*, and the central processing unit 2*c* periodically checks the signal interface to see whether or not the matrix of key switches 1*f* and/or the pedal switches 1*g* change the key status signal KS and/or the pedal status signal PS1. When the central processing unit 2*c* acknowledges a change of key status, the central processing unit generates a music data codes or codes MDC1 representative of at least key code and the current key status, i.e., key-on status or key-off status. On the other hand, when the pedal switches 1*g* informs the central processing unit 2*c* of a change of pedal status, the central processing unit 2*c* generates a music data code MDC2. If the pedal status signal PS informs the central processing unit 2*c* of the change of pedal status of the soft pedal 1*c*, the music data code MDC2 represents at least the soft pedal 1*c* and the bend indicative of an increment of pitch. Thus, the central processing unit 2*c* successively generates the music data codes MDC1 and MDC2 during a performance, and transfers the music data codes MDC1 and MDC2 to the tone generator 2*d*.

The read only memory 2*a* stores not only a program sequence executed by the central processing unit 2*c* but also pieces of standard pitch data information. The pieces of standard pitch data information are representative of standard pitches for the notes of the scale assigned to the electronic sounds. The standard pitches may be modified by the player, and the modified pitches are stored in the random access memory 2*b*. The central processing unit 2*c* transfers the pieces of pitch data information representative of the standard pitches or the modified pitches from the read only memory 2*a* or the random access memory 2*b* to the tone generator 2*d* before starting a performance.

Various switches are provided on the manipulating panel 2*e*. One of the switches is a power supply switch. The player connects the music data processing system 2 and the sound system 3 to an external power source and cuts the electric power by manipulating the power supply switch. Another switch is a volume control switch. The player varies the loudness of the electronic sounds by using the volume control switch. Yet another switch is used for selecting a timbre from the candidates.

Figure 2:
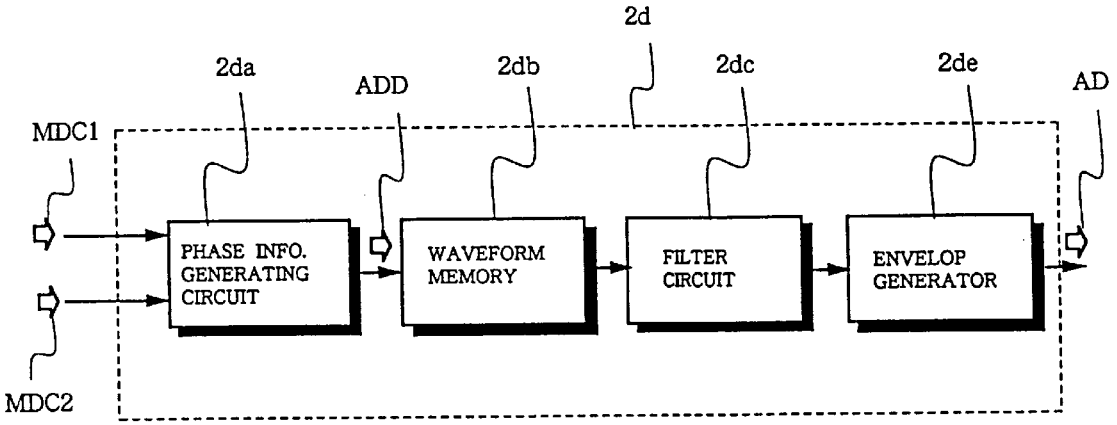
FIG. 2 is a block diagram showing the circuit arrangement of a tone generator incorporated in the electronic keyboard musical instrument.

FIG. 2 illustrates the circuit arrangement of the tone generator 2*d* incorporated in the music data processing system 2. The tone generator 2*d* includes a phase information generating circuit 2*da*, a waveform memory 2*db*, a filter circuit 2*dc* and an envelop generator 2*de*. The music data codes MDC1/MDC2 are supplied to the phase information generating circuit 2*da*, and the analog audio signal AD is supplied from the envelop generator 2*de* to the sound system 3.

The waveform memory 2*db* stores pieces of waveform information, and the envelop generator 2*de* tailors the analog audio signal AD on the basis of the pieces of waveform information. The sound generating process is called as "waveform memory read-out technology".

The waveform memory read-out technology is briefly described. Acoustic sounds were previously sampled, and the sampled waveform data were digitized so as to store the waveform memory 2*db*. A set of digital waveform data codes is representative of the waveform of an acoustic sound, and a plurality of sets of digital waveform data codes are respectively provided for the notes of the electronic sounds in a certain timbre. As described hereinbefore, the electronic keyboard musical instrument can give various timbres to the electronic sounds, and a set of digital waveform data codes are stored for each of the timbres selectable through the manipulating panel 2*e*. When the player depresses one of the black and white keys 1*d*/1*e*, the central processing unit 2*c* instructs the tone generator 2*d* to sequentially read out the digital waveform data codes from the read only memory 2*a* in response to a tempo clock signal corresponding to the pitch of the note specified by the depressed key 1*d*/1*e*.

The central processing unit 2*c* teaches the key code assigned to a depressed key 1*d*/1*e* through the music data code MDC1 to the phase information generating circuit 2*da*. When the player steps on the soft pedal 1*c*, the central processing unit 2*c* further teaches the bend indicative of an increment of pitch through the music data code MDC2 to the phase information generating circuit 2*da*. The phase information generating circuit 2*da* produces pieces of phase data information from the key code and the bend, and supplies the piece of phase data information to the waveform memory 2*db*.

As described hereinbefore, the waveform memory 2*db* stores the plurality of sets of waveform data codes each representative of the waveform of an acoustic sound, and one of the sets of waveform data codes corresponds to the electronic sound to be produced in response to the depressed key 1*d*/1*e*. The tone generator 2*d* selects a set of waveform data codes depending upon the key code, and the selected set of waveform data codes specifies a series of discrete values from the rise to the decay. The waveform data codes of the selected set are sequentially read out from the waveform memory 2*db* through the filter circuit 2*dc* to the envelop generator 2*de*, and the envelop generator 2*de* tailors the analog audio signal AD on the basis of the series of discrete value. If the read-out speed of the waveform data codes of the selected set is increased, the pitch of the electronic sound is changed.

The filter circuit 2*dc* is an active filter, and eliminates high frequency components from the waveform data information represented by the waveform data codes.

The envelop generator 2*de* multiplies the discrete value of the waveform data code by a certain value represented by an envelop signal so as to give a selected envelop to the analog audio signal AD. The envelop is usually divided into an attack immediately after depressing a key 1*d*/1*e*, a decay for a sustain and a release at release of the depressed key 1*d*/1*e*. Thus, the envelop generator 2*de* gives the envelop to the analog audio signal AD, and the sound system 3 produces the electronic sound in the selected timbre.

Assuming now that the player depresses one of the black and white keys 1*d*/1*e* and concurrently steps on the soft pedal 1*c*, the matrix of key switches if supplies the key status signal KS representative of the change of key status from the key-off to the key-on for the depressed key 1*d*/1*e* to the signal interface, and the pedal switch 1*g* supplies the pedal status signal PS representative of the step-on of the soft pedal 1*c* to the signal interface.

The central processing unit 2*c* identifies the depressed key 1*d*/1*e*, and produces the music data code MDC1 representative of the key code and the change of key status from the key-off to the key-on. The central processing unit 2*c* further produces the music data code MDC2 representative of the step-on of the soft pedal 1*c* and the bend.

The central processing unit 2*c* teaches the key code and the bend to the phase information generating circuit 2*da*.

The standard/modified pitch data information has been already transferred to the phase information generating circuit 2*da*, and the phase information generating circuit 2*da* forms a piece of composite phase data information from the piece of standard/modified pitch data information selected by using the key code and the increment of pitch represented by the bend. The piece of composite phase data information is indicative of a read-out speed for the waveform data codes of a selected set, and the bend increases the read-out speed rather than a read-out speed without the step-on of the soft pedal 1*c*.

The phase information generating circuit produces an address signal ADD on the basis of the piece of composite phase data information, and sequentially increments the address represented by the address signal ADD at the read-out speed.

The address signal ADD is supplied to the waveform memory 2*db*, and the waveform data codes are sequentially read out from the waveform memory 2*db* faster than waveform data codes specified without the step-on of the soft pedal 1*c*. The waveform data codes sequentially pass through the filter circuit 2*dc*, and are supplied to the envelop generator 2*de* so as to tailor the analog audio signal AD.

The central processing unit 2*c* may instruct the envelop generator 2*de* to slightly decrease the loudness of the electronic sound under the manipulation of the soft pedal 1*c*.

As described hereinbefore, if waveform data codes of a selected set are read out from the waveform memory 2*db* faster than usual, the electronic sound becomes higher in pitch. For this reason, the electronic sound is slightly higher in pitch than an electronic sound produced without the step-on of the soft pedal 1*c*. If the piece of standard pitch information is indicative of 400 Hz, the bend causes the phase information generating circuit 2*da* to increase the read-out speed at 0.05 percent, and the sound system 3 produces the electronic sound at 440.2 Hz.

Thus, the tone generator 2*d* slightly increase the pitch of the electronic sound, and the music data processing system 2 according to the present invention imparts the effects similar to those of the soft pedal of an acoustic piano to the electronic sounds.

Second Embodiment

Figure 3:
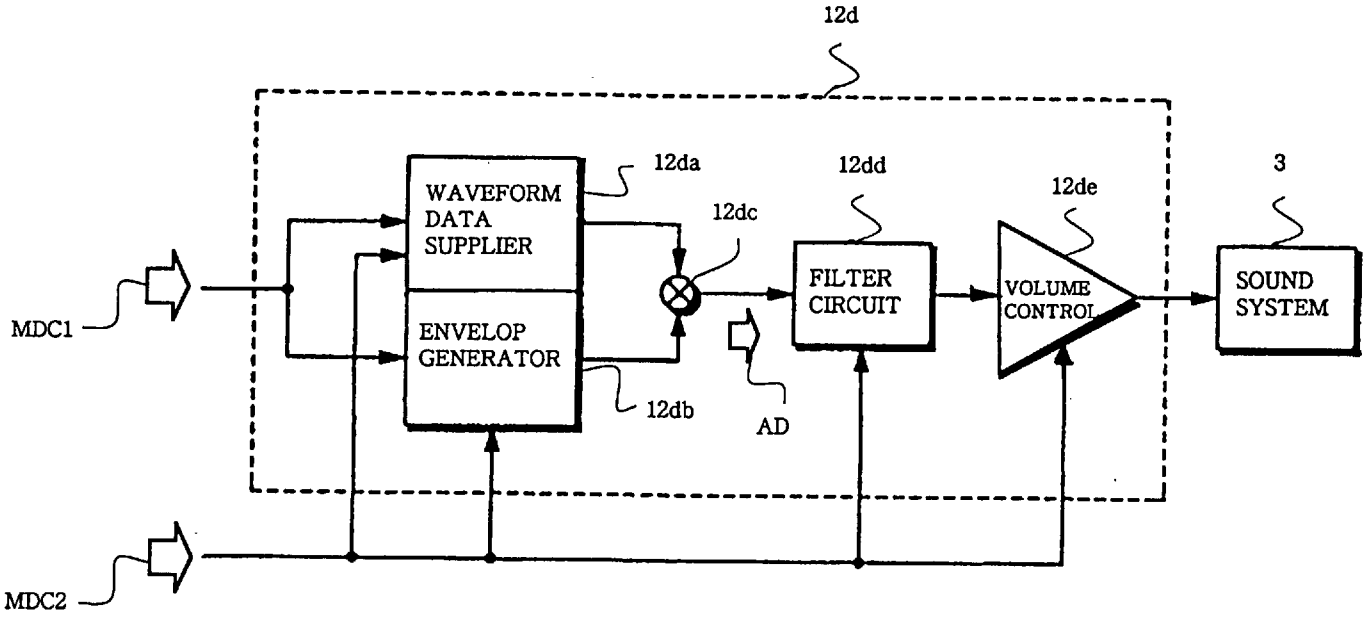
FIG. 3 is a block diagram showing the circuit arrangement of a tone generator incorporated in another electronic keyboard musical instrument according to the present invention.

Another electronic keyboard musical instrument embodying the present invention has an arrangement similar to that of the first embodiment shown in FIG. 1 except for a tone generator 12*d* shown in FIG. 3, and the other components are specified by using the same references as those of the first embodiment in the following description.

The tone generator 12*d* includes a waveform data supplier 12*da*, an envelop generator 12*db*, a multiplier 12*dc*, a filter circuit 12*dd* and a volume controller 12*de*. The waveform data supplier 12*da* may correspond to the phase information generating circuit 2*da* and the waveform memory 2*db*. The envelop generator 12*db* is responsive to the music data code MDC representative of the key code so as to produce an envelop signal, and controls the loudness and the duration of an electronic sound.

The music data code MDC representative of the key code is supplied to both of the waveform data supplier 12*da* and the envelop generator 12*db*, and the music data code MDC2 representative of the step-on of the soft pedal 1*c* is supplied to the waveform data supplier 12*da*, the envelop generator 12*db*, the filter circuit 12*dd* and the volume controller 12*de*. A series of waveform data codes are multiplied by envelop data at the multiplier 12*dc*, and an analog audio signal AD is supplied to the filter circuit 12*dd*.

The filter circuit 12*dd* is responsive to the music data code MDC2 so as to eliminate high-frequency components from the analog audio signal 12*dd*, and the loudness of the volume control 12*de* is regulated by the volume control 12*de*.

Assuming now that a player steps on the soft pedal 1*c* during a performance, the central processing unit 2*c* acknowledges the step-on of the soft pedal 1*c* through the pedal status signal PS, and identifies a key or keys 1*d*/1*e* depressed during the step-on of the soft pedal 1*c*. The central processing unit 2*c* supplies the music data code MDC1 representative of the key code assigned to the depressed key 1*d*/1*e* to the waveform data supplier 12*da* and the envelop generator 12*db*, and informs the waveform data supplier 12*da*, the envelop generator 12*db*, the filter circuit 12*dd* and the volume control 12*de* of the step-on of the soft pedal 1*c*.

Figure 4:
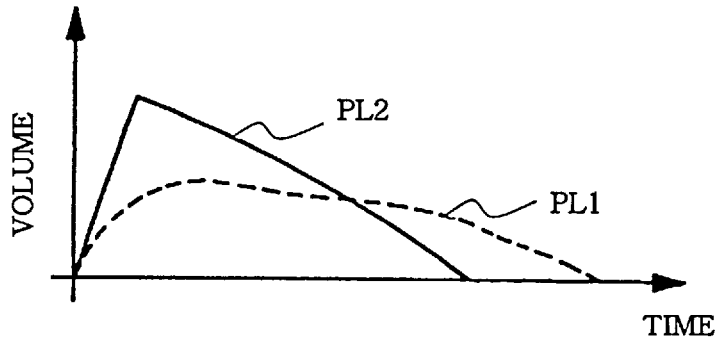
FIG. 4 is a graph showing waveforms of an electric signal differently tailored depending upon a step-on of a soft pedal.

The waveform data supplier 12*da* outputs a series of waveform data codes at a certain speed higher than usual as similar to the waveform memory 2*db*, and the envelop generator outputs the envelop data representative of a gentle envelop as indicated by plots PL1 in FIG. 4. When the soft pedal 1*c* is not depressed, the envelop generator 12*db* outputs the envelop data representative of a steep envelop indicated by plots PL2. The envelop PL1 has a gentle attack, and the peak of the gentle envelop is lower than the peak of the steep envelop PL2. The gentle envelop PL1 is smaller in decay angle than the steep envelop PL2, and the gentle envelop PL1 is prolonged rather than the steep envelop PL2. Thus, the envelop generator 12*db* supplies the gentle envelop PL1 to the multiplier 12*dc* so as to decrease the loudness and prolong the duration under the step-on of the soft pedal 1*c*.

The multiplier 12*dc* multiplies the series of the waveform data codes by the envelop data representative of the gentle envelop PL1, and forms the analog audio signal AD.

Figure 5:
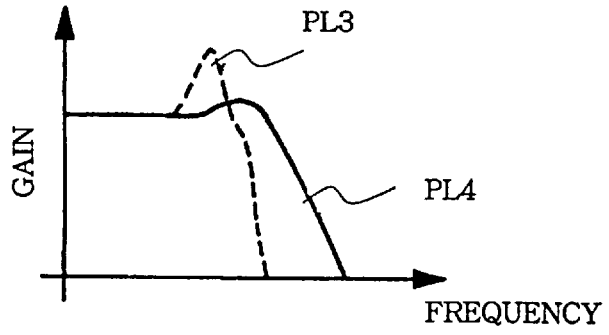
FIG. 5 is a graph showing a gain in terms of the frequency component of an analog audio signal in a filter circuit of the tone generator.

The filter circuit 12*dd* is responsive to the music data code MDC2 representative of the step-on of the soft pedal 1*c* so as to enhance the quality factor. When the quality factor is enhanced, the high frequency components of the analog audio signal AD is widely cut off, and a certain frequency range is emphasized as will be understood from plots PL3 in FIG. 5. Plots PL4 represents the filtering characteristics without a step-on of the soft pedal 1*c*. Thus, the soft pedal 1*c* causes the filter circuit 12*dd* to emphasize a sound component in the certain frequency range of the electronic sound.

The volume control 12*de* is also responsive to the music data code representative of the step-on of the soft pedal 1*c* so as to slightly decrease the loudness of the electronic sound.

The analog audio signal AD treated in this way is supplied to the sound system 3, and the sound system 3 produces the electronic sound similar to the piano sound produced under the step-on of the soft pedal of an acoustic piano.

In this instance, the waveform data supplier 12*da* slightly increases the pitch of the electronic sound, and the envelop generator 12*db* and the filter circuit 12*dd* modifies the frequency characteristics. As described hereinbefore, the soft pedal of an acoustic piano causes the hammer to strike a smaller number of strings. When a pianist does not step on the soft pedal, the hammer usually strikes three strings. The hammer strikes two strings at different points on the strings under the step-on of the soft pedal.

When the three strings are concurrently struck, vibrations take place in the three strings, and the three strings are in-phase. For this reason, the three strings are interfered with one another, and the piano sound is rapidly decayed. In other words, the attenuation energy is so large that the three strings rapidly decays the piano sound.

On the other hand, when the pianist steps on the soft pedal, only two strings vibrate, and make the attack of the piano sound small. However, the energy is transferred from the vibrating two strings to the other string during the attenuation, and the attenuation energy of the three strings are smaller than that of the three vibrating strings directly struck by the hammer. This results in a long sustain. This is the reason why the envelop generator 12*db* provides the gentle envelop to the analog audio signal AD.

Moreover, the coupled vibration between the strings and the bridges is widely changed due to the decrease of struck strings and the different impact point. As a result, the amplitude of the vibrations is decreased, and the mechanical impedance of the bridges is enlarged from the aspect on the string side. This is equivalent to a shrinkage of the strings, and the pitch is increased. This is the reason why the waveform data supplier supplies the series of waveform data codes faster than usual.

Finally, high-order harmonics are liable to take place in the non-struck string, and high-frequency components are emphasized. This is the reason why the filter circuit 12*dd* provides a large gain to the certain frequency range of the analog audio signal AD.

As will be understood from the foregoing description, the tone generator 12*d* causes the electronic sound to have a small attack, a long sustain, slightly higher pitch and emphasized high-frequency components.

Although particular embodiments of the present invention have been shown and described, it will be obvious to those skilled in the art that various changes and modifications may be made without departing from the spirit and scope of the present invention.

For example, the tone generator may produce a plurality of electronic sounds equal in pitch in response to a change of key status from the key-off to the key-on. In this instance, when a player steps on the soft pedal 1*c*, the tone generator slightly increases the pitch of one or more than one electronic sound. The tone generator is assumed to produce three electronic sounds equal in pitch without a step-on of the soft pedal 1*c*. When the player steps on the soft pedal 1*c*, the tone generator may slightly increase the pitch of two electronic sounds and keep the pitch of the remaining electronic sound. The composite electronic sound is much closer to the acoustic piano sound produced under the step-on of the soft peal.

The increment of the pitch may be different between the groups of keys or between the individual keys. A player may change the increment of the pitch under the step-on of the soft pedal 1*c*.

The present invention may be applied to a synthesizer in which a central processing unit generates synthesized sounds under the control of a sequencer. In this instance, the increment of pitch may be achieved by multiplying a control data representative of a read-out speed for the waveform data by a factor more than 1. The factor may be 1.0005.

What is claimed is:

1. An electronic keyboard musical instrument comprising:

a keyboard having a plurality of keys selectively depressed by a player for specifying a note of an electronic sound;

a pedal adapted to be depressed by said player for imparting predetermined effects to said electronic sound; and a tone generator responsive to one of said plurality of keys depressed by said player for producing said electronic sound, said tone generator being further responsive to said one of said plurality of keys and said pedal depressed by said player for both slightly increasing the pitch of said electronic sound and decreasing the loudness of said electronic sound, in order to thereby simulate a soft pedal operation of an acoustic piano.

2. The electronic keyboard musical instrument as set forth in claim 1, in which said tone generator includes a waveform memory for storing a plurality of sets of waveform data codes respectively corresponding to electronic sounds selectively produced when said player depresses said plurality of keys, a read-out unit responsive to a first piece of music data information representative of said one of said plurality of keys for reading out the waveform data codes of one of said plurality of sets at a first speed, said read-out unit being concurrently responsive to said first piece of music data information and a second piece of music data information representative of said pedal depressed by said player for reading out said waveform data codes of said one of said plurality of sets at a second speed higher than said first speed, and an envelop generator imparting an envelop to said waveform data codes of said one of said plurality of sets for producing an audio signal.

3. The electronic keyboard musical instrument as set forth in claim 1, in which said tone generator further prolongs said electronic sound and emphasizes certain frequency components of said electronic sound when said pedal and said one of said plurality of keys are concurrently depressed.

4. The electronic keyboard musical instrument as set forth in claim 3, in which said tone generator includes a waveform data supplier storing a plurality of sets of waveform data codes respectively corresponding to electronic sounds selectively produced when said player depresses said plurality of keys, and responsive to a first piece of music data information representative of said one of said plurality of keys for reading out the waveform data codes of one of said plurality of sets at a first speed, said waveform data supplier being concurrently responsive to said first piece of music data information and a second piece of music data information representative of said pedal depressed by said player for reading out said waveform data codes of said one of said plurality of sets at a second speed higher than said first speed, an envelop generator responsive to said first piece of music data information for producing a first envelop, said envelop generator being responsive to said first and second pieces of music data information for producing a second envelop having a peak of attach lower than that of said first envelop and a sustain longer than that of said first envelop, a multiplier connected to said waveform data supplier and said envelop generator, and imparting one of said first envelop and said second envelop to said waveform data codes of said one of said plurality of sets for producing an audio signal, a filter circuit connected to said multiplier, and responsive to said second piece of music data information for eliminating a high-frequency component from said audio signal and emphasizing a certain frequency component, and a volume controller connected to said filter circuit, and responsive to said second piece of music data information for changing a amplitude range of said audio signal.

* * * * *